US006543646B2

(12) United States Patent
Gibson

(10) Patent No.: US 6,543,646 B2
(45) Date of Patent: Apr. 8, 2003

(54) METHOD AND APPARATUS FOR REMOTELY DISPENSING BEVERAGES

(75) Inventor: Paul Gibson, Clearwater, FL (US)

(73) Assignee: Food Cart Systems, Inc., Clearwater, FL (US)

( * ) Notice: Subject to any disclaimer, the term of this patent is extended or adjusted under 35 U.S.C. 154(b) by 0 days.

(21) Appl. No.: 09/883,632

(22) Filed: Jun. 18, 2001

(65) Prior Publication Data

US 2002/0003148 A1 Jan. 10, 2002

Related U.S. Application Data

(60) Provisional application No. 60/212,609, filed on Jun. 19, 2000.

(51) Int. Cl.[7] ..... B67D 5/56
(52) U.S. Cl. ..... 222/129.1; 222/146.6
(58) Field of Search ..... 222/129.1, 129.4, 222/145.6, 146.1, 146.6, 64, 56

(56) References Cited

U.S. PATENT DOCUMENTS 2,741,400 A 4/1956 Hazzard
2,894,377 A * 7/1959 Shikles, Jr. et al. ..... 222/129.1
3,224,641 A * 12/1965 Morgan ..... 222/129.1
4,477,003 A * 10/1984 Baker et al. ..... 222/146.1
5,314,091 A * 5/1994 Credle, Jr. ..... 222/129.1
5,395,013 A * 3/1995 Billings ..... 222/129.1
5,575,405 A 11/1996 Stralton et al.
6,149,035 A * 11/2000 Gorski et al. ..... 222/129.1
6,196,422 B1 * 3/2001 Tuyls et al. ..... 222/129.1

* cited by examiner

*Primary Examiner*—Philippe Derakshani
(74) *Attorney, Agent, or Firm*—Carr Law Firm, L.L.P.

(57) ABSTRACT

The invention comprises a system for maintaining the freshness of a beverage, while allowing a delivery of the beverage to customers at a visually appealing, remote dispensing station. A quantity of the beverage is maintained within a beverage tank housed within an enclosure that may be maintained at a preferred temperature or temperature range. The contents of the beverage container are delivered to a remote dispensing station, by a dispensing pump and dispensing conduit connected between a flow valve on the beverage tank and the dispensing station.

33 Claims, 4 Drawing Sheets

METHOD AND APPARATUS FOR REMOTELY DISPENSING BEVERAGES

This application claims the benefit of Provisional Application No. 60/212,609 filed Jun. 19, 2000.

FIELD OF THE INVENTION

The invention relates to provision of beverages and, more particularly, to a method and apparatus for keeping one or more beverages fresh and dispensing the beverages remotely from a station visually appealing to a customer.

BACKGROUND OF THE INVENTION

There are many methods and apparatuses for dispensing cool, fresh beverages outdoors to a large number of people.

Beverages may be dispensed by an insulated cart apparatus. However, the insulated cart design has many problems associated with dispensing beverages to a large number of people. The quantity of beverages that can be stored in the cart is small. The cart is generally mobile and therefore has weight restrictions limiting its size and volume. The interior of the cart also requires space for insulation, ice, or a refrigeration unit, which further limits the space or volume available for beverage storage. Carts are therefore only able to serve a small number of customers before requiring a refill. Many carts are only able to dispense canned or bottled beverages, which are more expensive than beverages dispensed by the cup. It is also difficult to keep the cans and bottles cold, because the interior of the cart loses coolness each time a beverage is removed.

Another type of design employed to dispense cool beverages such as fruit juices outdoors is a homemade juice stand. Such stands dispense juice by the glass, and some also allow the customer to view fresh juice being made. The homemade stand, however, is costly, messy and labor intensive. Raw fruit and vegetable materials for juice production are expensive and require a large volume of storage space. In addition, a large work area is necessary to prepare the juice, and numerous personnel are needed to prepare large quantities of juice. Squeezing the fruits by hand is extremely labor intensive, and squeezing or blending the juices mechanically requires costly equipment that is difficult to clean.

Another design used in outdoor beverage sales is that of a stand with a countertop "pre-mix" or "post-mix" dispenser apparatus. Pre-mix dispensers are used to serve a finished beverage through a fountain head located on the dispenser unit. The holding tank may be opaque or transparent for display purposes. Post-mix dispensers do not store pre-mixed or already blended syrup and water. Instead, the syrup, water and, in some cases, $CO_2$, are conveyed by separate conduits to a dispenser housing and then mixed immediately prior to being dispensed through a fountain head on the housing. The syrup may be stored remotely from the dispenser housing in a metallic cylinder or in a collapsible plastic bag in a cardboard box.

A traditional pre-mix dispenser consists of a refrigeration unit mounted on a counter and a display container for the beverage mounted on and above the refrigeration unit. A cover or lid for the open top of the display container is removable to enable refilling. The container often has a mechanism for agitating the beverage to maintain homogeneity for juices and uniform cooling of the beverage, or merely to enhance the attractiveness of the beverage display. Two of the problems associated with the traditional pre-mix dispenser apparatus are its small dispensing capacity and counter space location. The countertop display container often holds most, if not all, of the stored beverage, and due to limitations of available counter space, does not hold a very large quantity of the beverage. The container therefore needs to be frequently refilled in order to serve a large number of customers efficiently. The refills are messy, time consuming, and unsightly. The container also needs to be cleaned frequently to prevent bacteria buildup.

A post-mix dispenser does not require manual refilling: there is no display bowl to refill, and the concentrate, water and, in some cases, $CO_2$, are mixed automatically. The post-mix apparatus, however, typically lacks an appealing visual display to prompt impulse purchases. The post-mix dispenser also does not have the counter space location problems of the pre-mix dispenser, because the beverage concentrate generally resides at a remote location. The apparatus does, however, require a dedicated water line for provision of beverage. Since concentrate, water, and in some cases $CO_2$, are mixed for each individual beverage, it can be difficult to control the precise ratio if any of the regulators that control mixing, the water line, concentrate line, concentrate pump, or dispensing faucet are malfunctioning. Further, there is no quality control check on the beverage until it is already served, and the customer has received inferior quality beverage.

Dispenser and beverage manufacturers have been unable to provide an apparatus and method for efficiently dispensing a large quantity of beverage to the public in remote locations or outdoors. Each previous design has significant shortcomings that limit the amount of beverage able to be dispensed, the cost effectiveness of the dispensing method, the efficiency of the dispensing process, the visual display prompting impulse purchases, or the quality of the beverage itself.

SUMMARY OF THE INVENTION

The invention comprises a system for maintaining the freshness of a beverage while allowing a delivery of the beverage to customers at a visually appealing remote dispensing station. A quantity of the beverage is maintained in a beverage tank housed within an enclosure. The contents of the beverage tank are delivered to one or more dispensing pumps in a remote dispensing station by means of a dispensing conduit connected between a flow valve on the beverage tank and the dispensing pump in the remote dispensing station. The beverage is then dispensed from a serving valve in the remote dispensing station, which is connected to the dispensing pumps by means of serving conduit.

In one aspect of the invention, the beverage tank has a fill opening for adding beverage ingredients.

In another aspect of the invention, the temperature of the enclosure and beverage tank are regulated by means of a refrigeration unit and condenser.

In yet another aspect of the invention, a mixing pump circulates the beverage within the beverage tank to promote uniform temperature, taste, and consistency of the beverage.

In one embodiment, the refrigeration unit, condenser, and mixing pump connect to an electrical power supply through an electrical conduit.

In one embodiment, the dispensing pump actuates in response to a pressure drop downstream of the pump; in another embodiment, the dispensing pump actuates in response to the opening of a serving valve connected to the dispensing pump via a serving conduit.

In yet another aspect of the invention, the remote dispensing station has the appearance of one or more fruits or vegetables associated with the beverage, such as a lemon if lemonade is dispensed, and the like.

In still another aspect of the invention, an upper portion of the remote dispensing station forms a closure that can be hinged or removed to allow a person to serve customers from within the lower portion of the remote dispensing station. In one embodiment, the person can enter the interior of the lower portion by a door connected to the lower portion of the remote dispensing station by a hinging mechanism.

In yet another aspect of the invention, one or more wheels are attached to one or more wheel axles mounted to the lower portion of the remote dispensing station, thus rendering the station mobile.

In one embodiment, a countertop upon which objects may be placed connects to a part of the lower portion of the remote dispensing station.

In another aspect of the invention, water service or a fresh water tank, and waste service or a wastewater tank are connected to the remote dispensing station. In one embodiment, both hot and cold running water are provided to service the beverage cart. In another embodiment, a sink is connected to the water and waste systems in the remote dispensing station. In yet another embodiment, the remote dispensing station has a multi-compartment sink for rinsing, soaking and drying glasses and other food and beverage containers as needed to meet various health and safety codes and regulations. In still yet another embodiment, an ice sink is installed in the remote dispensing station.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
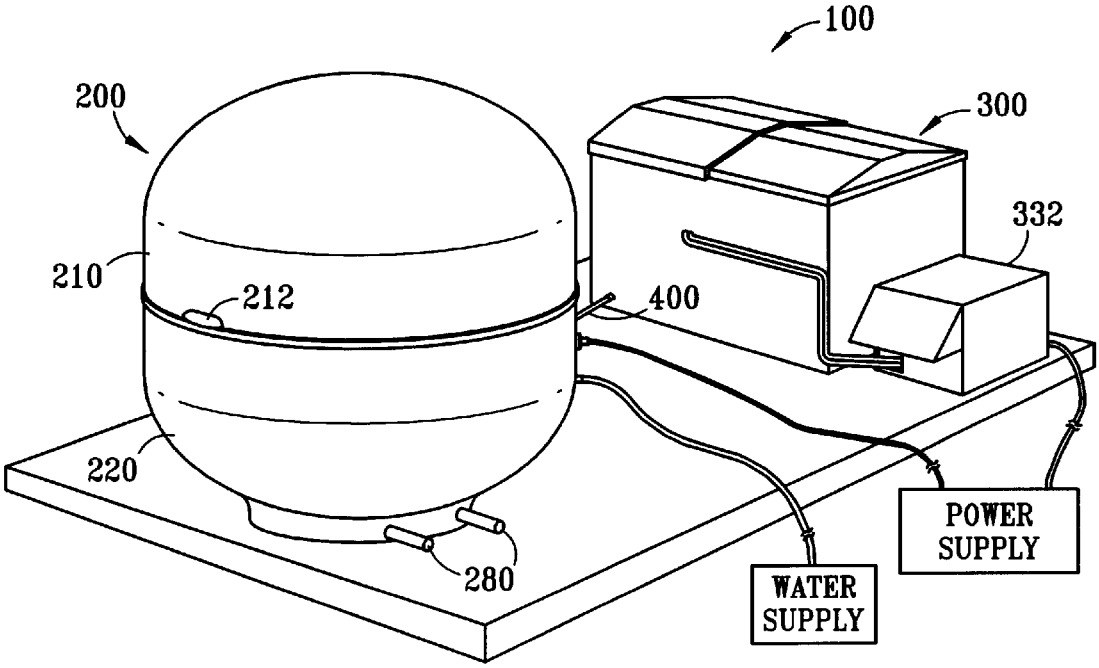
FIG. 1 depicts one embodiment of the remote beverage dispensing system with the dispensing station in a closed position.

The invention comprises a system for maintaining the freshness of a beverage, while allowing a delivery of the beverage to customers at a visually-appealing, remote dispensing station. Referring to FIG. 1, illustrated is a beverage delivery system 100. The system 100 includes a remote dispensing station 200 and a beverage storage enclosure 300. Interconnecting the station 200 and the enclosure 300 is a conduit 400, for delivery of a beverage stored in the enclosure 300 to the dispensing station 200. The remote dispensing station 200 is comprised of an upper portion 210 and a lower portion 220. From a position of closure, such as is shown here, the remote dispensing station 200 is pivoted to an open position by a person grasping a handle 212, connected to the upper portion 210, and lifting the upper portion 210 away from the lower portion 220.

The functional structure of the remote dispensing station 200 allows a large number of customers to be served efficiently. The lower portion 220 may have one or more wheel axles 280 attached to its base. Wheels may be placed on the axles 280 for mobility of the remote dispensing station 200. The remote dispensing station 200 can easily be moved to optimal customer locations. The enclosure 300 can be moved with the remote dispensing station 200, or the remote dispensing station 200 can be moved away from the enclosure 300 by extending the conduit 400 as necessary.

Figure 2:
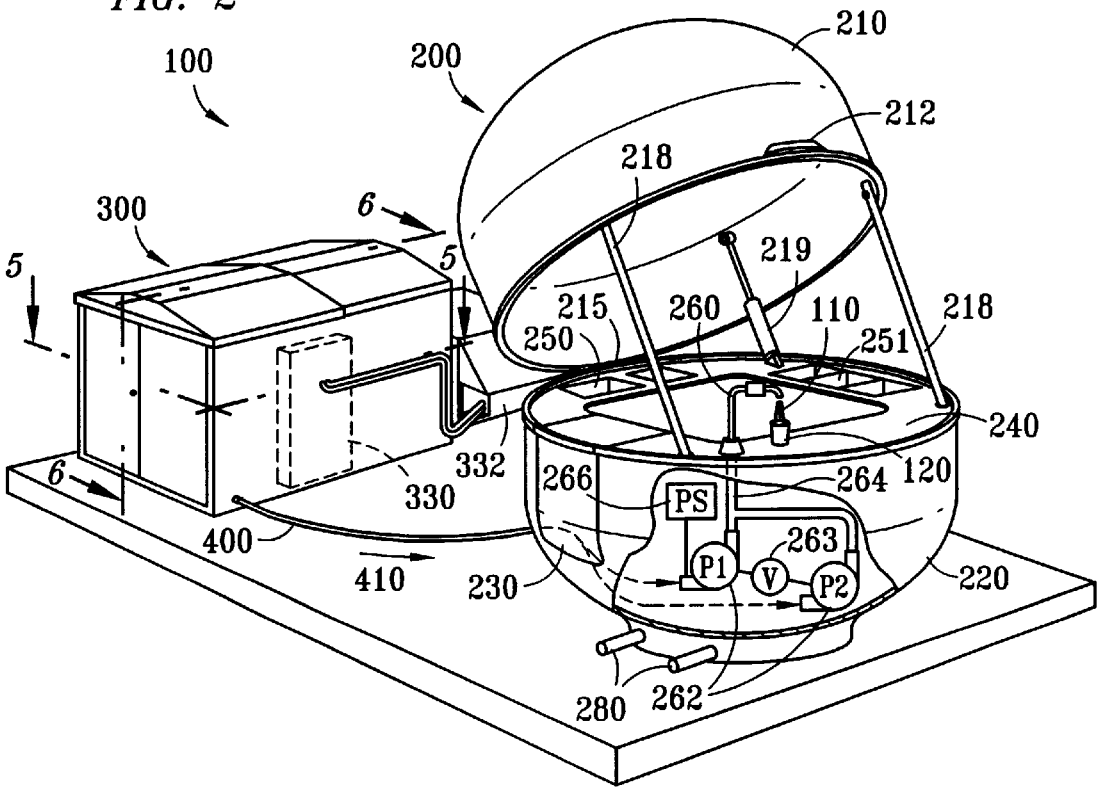
FIG. 2 depicts a partial cutaway view of one embodiment of the remote beverage dispensing system from an elevated side view.
Figure 3:
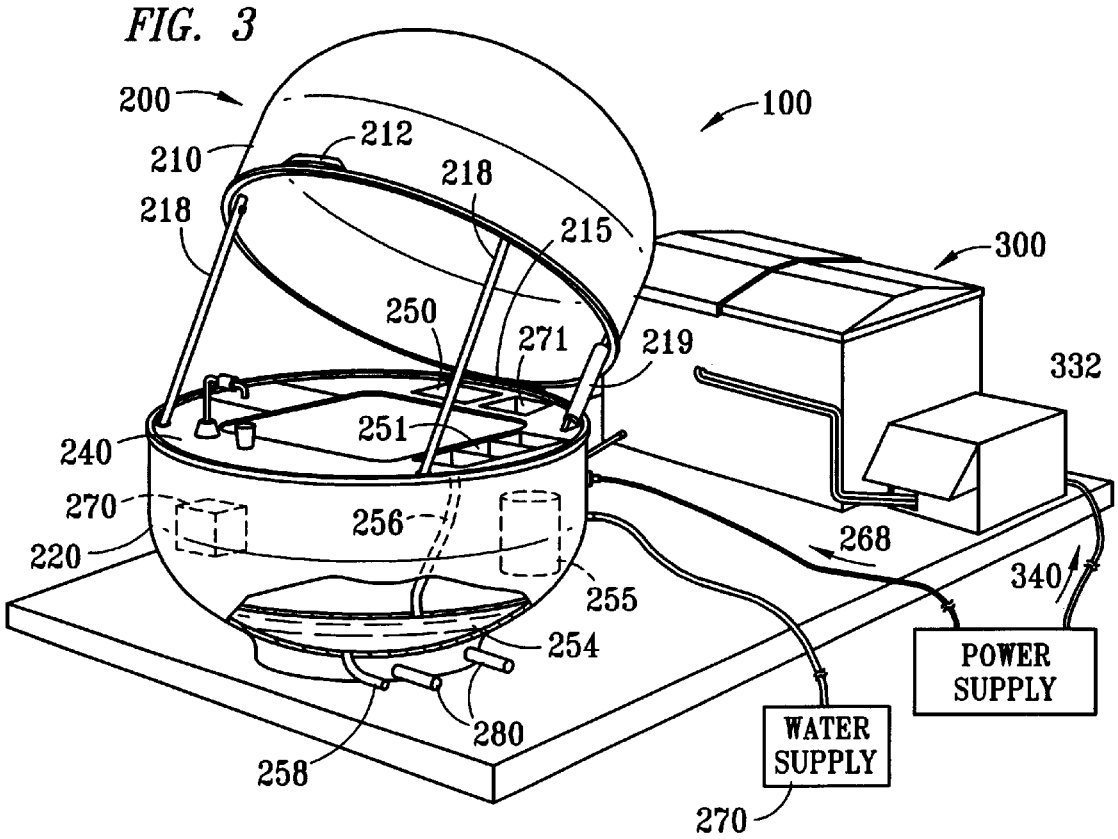
FIG. 3 depicts one embodiment of the remote beverage dispensing system from the opposite elevated side view.

Referring now to FIG. 2, it can be seen that the beverage 110 is dispensed into a cup 120 at the remote dispensing station 200 by means of one or more serving valves 260. The beverage 110 exits the dispensing pump 262 at a flow rate of approximately three to five gallons per minute and at a pressure range of up to approximately 35 pounds per square inch. Each serving valve 260 is connected to one or more beverage dispensing pumps 262 by a serving conduit 264. If both a primary and a secondary dispensing pump 262 are connected to a serving valve 260, a bypass valve 263 is used to turn off the primary dispensing pump and turn on the secondary dispensing pump, if the primary pump fails for any reason. The bypass valve 263 can operate automatically, or it may be manually activated by the station operator, depending upon the configuration chosen. The dispensing pump 262 can be actuated in response to a pressure drop in the serving conduit 264 as indicated by the pressure sensor 266, which measures the pressure in the serving conduit 264. In another embodiment of the system, the dispensing pumps 262 are actuated by a decrease in pressure actuated by the opening of the serving valves 260. The beverage 110 flows through the dispensing conduit 400 to the beverage dispensing pump 262 in the remote dispensing station 200 as indicated by arrow 410. The beverage dispensing pump 262 is connected to a power supply as shown in FIG. 3 by arrow 268. The power supply may be alternating current (AC) electric, or a battery. In one embodiment of the invention, any pumps, power supply, bypass valve and other equipment are housed in an enclosure in the rear of the lower portion 220 of the remote dispensing station 200.

Still referring to FIG. 2, a hinging mechanism 215 allows the upper portion 210 of the remote dispensing station 200 to pivot up from the lower portion 220 of the remote dispensing station 200 into an opened position. The upper portion 210 is kept in the open position by cylindrical metal posts 218 inserted between the lips of the two shells and held in place by cotter-type pins. An hydraulic piston lifting arm 219 is used to assist in the opening and closing of the upper portion 210 in some remote dispensing stations 200. A door 230 is connected to the lower portion 220 to allow access into the interior of the lower shell 220. A countertop 240 can be attached to part of the circumference of the lower portion 220. Objects such as a cash register or other items necessary to the servicing of customers can be placed upon the countertop 240.

As can be seen in FIG. 3, a variety of sinks may be attached to the countertop 240, as needed, including a general purpose sink 250, a multi-compartment rinsing, soaking and drying sink 251, and an ice sink 271. A sink can be connected to a water supply or fresh water tank 270. The multi-compartment sink 251 is used for rinsing, soaking, and drying of beverage containers and other food containers in compliance with health and safety laws. A hot water heater or tank 255 may be placed beneath countertop 240 and connected to the general-purpose sink 250 and/or multi-compartment sink 251 to provide hot running water. The hot water heater may be electric or propane operated. In one embodiment of the invention, the water heater 255 and water tank 270, if any, are housed in an enclosure in the rear of the lower portion 220 of the remote dispensing station 200, along with the dispensing pumps 262 and other equipment. Waste liquid from the sinks is drained to a wastewater tank 254 through an interior drain line 256. The wastewater tank 254 may be located within the lower portion 220 of the dispensing station 200, or it may be located outside the dispensing station. If the wastewater tank 254 is located within the lower portion 220 of the dispensing station 200, it will consist of one or more tanks that are removable, and that have a flat upper surface capable of bearing weight so that they form a floor on which the person dispensing beverages can stand while in the dispensing station 200. The waste liquid in the wastewater tank 254 can be drained by an exterior drain line 258.

The interior of the lower portion 220 may be used to store objects necessary to dispense the beverage or maintain the cleanliness of the remote dispensing station 200. An ice basin 270 may be placed within or connected to the interior front of the lower shell, if cooling of the beverage 110 by ice is necessary. If an ice sink 271 is attached to the remote dispensing station 200, it can be used as an ice source.

Figure 4:
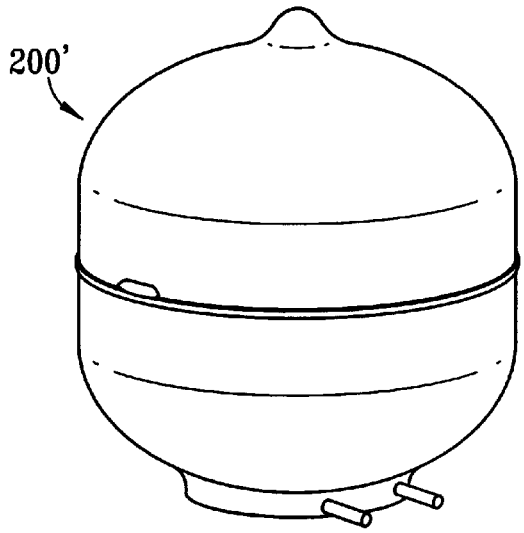
FIG. 4 depicts an embodiment of the remote beverage dispensing station formed to represent one or more fruits or vegetables associated with the beverage being dispensed in this case a lemon.

As shown in FIG. 4, for visual appeal, the remote dispensing station 200' may be formed to resemble one or more ingredients of the beverage, such as a lemon, if lemonade is being dispensed, or a pineapple, orange, grapefruit, apple, tangerine, tomato, and the like. The remote dispensing station 200' may also be formed to represent multiple items of fruit, such as a bunch of grapes or bunch of apples, or can be formed to represent a collection or arrangement of fruit pieces of the same or different types, such as a basket of various fruit, and the like. The remote dispensing station 200' may be painted or coated to further enhance the resemblance to the beverage ingredient(s).

Figure 5:
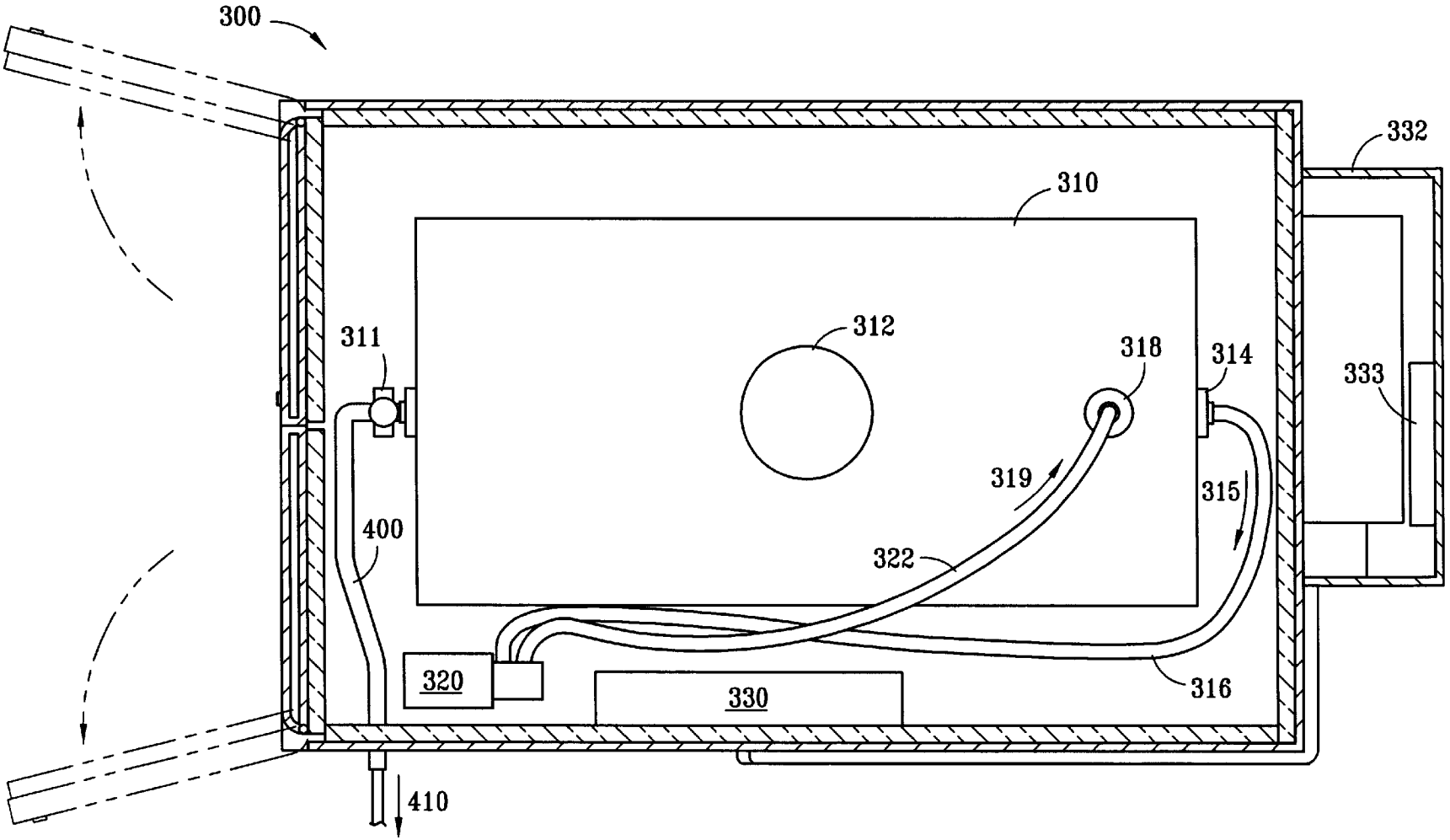
FIG. 5 depicts a top cutaway view of the storage unit and beverage tank.
Figure 6:
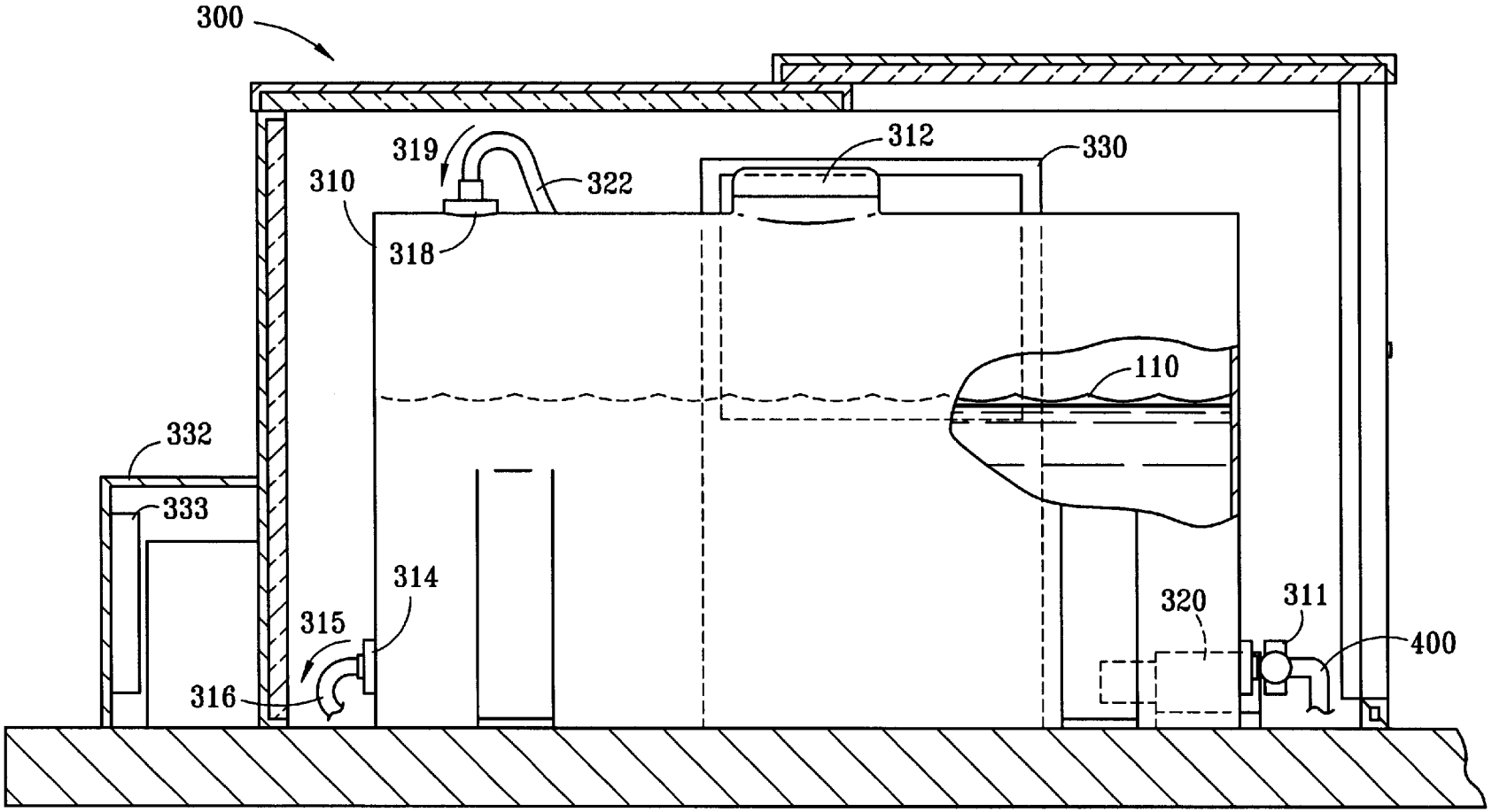
FIG. 6 depicts a side cutaway view of the storage unit and beverage tank.

Referring to FIGS. 5 and 6, illustrated is the interior of the enclosure 300 from an overhead perspective and side perspective, respectively. The enclosure 300 houses the beverage tank 310 for storage of a quantity of the beverage 110, and a mixing pump 320 for continuous circulation of the beverage 110 within the beverage tank 310. In one embodiment, a wall-mounted refrigeration unit 330 for cooling of the enclosure 300 is also housed in the enclosure 300. The beverage tank 310 holds a large amount of beverage 110 so that less frequent refills of the beverage tank 310 are necessary.

The ingredients of the beverage 110 are added to the beverage tank 310 through a fill opening 312 on top of the beverage tank 310. A portion of the beverage 110 is circulated continuously within the beverage tank 310 whenever it is operating to promote uniform temperature, taste and consistency of the beverage. The circulation occurs when the beverage 110 exits the beverage tank 310 through a lower tap 314 on the beverage tank 310 and enters the feed conduit 316 as shown by arrow 315. The beverage 110 then flows from the feed conduit 316 into the mixing pump 320 and is discharged from the mixing pump 320 into the discharge conduit 322 at a flow rate of approximately one thousand gallons per hour and at a pressure range of up to approximately 40 pounds per square inch. The beverage 110 flows from the discharge conduit 322 through an upper tap 318 back into the beverage tank 310 as shown by arrow 319, to complete the circulation route.

A portion of the beverage 110 exits the beverage tank 310 through a flow valve 311 and enters the dispensing conduit 400. When the flow valve 311 is open, the beverage 110 flows through the dispensing conduit 400 to the remote dispensing station 200 as indicated by arrow 410.

The temperature of the enclosure 300 may be regulated by a refrigeration unit 330. The refrigeration unit 330, if used, is mounted on an interior wall of the enclosure 300, and is connected to a condenser 332. The condenser 332, in one embodiment of the invention, is located outside of the enclosure 300. If a refrigeration unit 330 is used, a timer shutoff switch 333 is attached to the power supply for refrigeration unit 330 and condenser 332 and turns the units off and on at specified intervals for maximum cooling efficiency. The condenser 332, refrigeration unit 330, and mixing pump 310 are connected to a power supply as indicated by arrow 340 shown in FIG. 3.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot; and a fill opening in the beverage tank for adding the beverage or one or more beverage ingredients.

2. The system of claim 1, further comprising an enclosure surrounding the beverage tank.

3. The system of claim 1, further comprising:

an environmentally-controlled enclosure surrounding the beverage tank for maintaining the tank and the beverage it contains at a selected temperature or within a selected temperature range.

4. The system of claim 1, further comprising:

an environmentally-controlled enclosure surrounding the beverage tank;

a wall mounted refrigeration unit located inside of the environmentally-controlled enclosure for temperature regulation of the enclosure; and a condenser, located outside of the enclosure, connected to the refrigeration unit for temperature regulation to maintain the tank and the beverage it contains at a selected temperature or within a selected temperature range.

5. The system of claim 1, further comprising:

an environmentally-controlled enclosure surrounding the beverage tank;

a wall mounted refrigeration unit located inside of the environmentally-controlled enclosure for temperature regulation of the enclosure;

a condenser, located outside of the enclosure, connected to the refrigeration unit for temperature regulation to maintain the tank and the beverage it contains at a selected temperature or within a selected temperature range; and a timer device to periodically turn the refrigeration unit on and off at specified intervals to achieve maximum cooling efficiency.

6. The system of claim 1 wherein said at least one dispensing pump actuates in response to the opening of the dispensing spigot.

7. A system for providing a beverage, comprising:

a remote dispensing station, for delivery of the beverage to customers;

at least one beverage tanks for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot; and a mixing pump for circulating the beverage in the beverage tank.

8. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot;

an outlet on the beverage tank;

a feed conduit connected to the outlet for drawing the beverage out of the beverage tank and into the mixing pump;

a discharge conduit connected to an outlet of the mixing pump; and an inlet on the beverage tank connected to the discharge conduit for discharge of the beverage from the mixing pump back into the beverage tank.

9. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot; and a pressure sensor associated with the at least one dispensing pump for actuating the dispensing pump when the pressure of the beverage in the serving conduit drops below a selected level or range.

10. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station; and at least two dispensing pumps, having access to the beverage, the at least two dispensing pumps being interconnected by a bypass valve, the bypass valve being configured to select a dispensing pump to operate for delivery of the beverage to the dispensing spigot.

11. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot; and an ice basin connected to the interior of the remote dispensing station.

12. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot; and a sink connected to the interior of the remote dispensing station.

13. The system of claim 12 wherein the sink is a multi-compartment sink for cleaning beverage and food containers in compliance with health and safety regulations connected to the interior of the remote dispensing station.

14. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot;

all incoming water line connected to the remote dispensing station to provide water to the remote dispensing station; and a water outlet from the remote dispensing station.

15. The system of claim 14 further comprising a hot water heater connected to the incoming water line to provide hot water.

16. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot;

a fresh water tank attached or connected to the remote dispensing station to provide water to the remote dispensing station; and a wastewater tank attached or connected to the remote dispensing station or enclosure.

17. The system of claim 16 further comprising a hot water heater attached to the fresh water tank to provide hot water to the remote dispensing station.

18. A system for providing a beverage, comprising;

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot; and a substantially planer countertop connected to a portion of the remote dispensing station.

19. A system for providing a beverage, comprising:

a remote dispensing station, for delivery of the beverage to customers;

at least one beverage tank, for containing a quantity of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot; and a wheel rotably connected to the remote dispensing station for moving of the remote dispensing station.

20. A system for providing a beverage, comprising:

a remote dispensing station, for delivery of the beverage to customers, at least one beverage tank, for containing a quantity of the beverage, wherein the remote dispensing station comprises a lower portion and an upper portion, mounted to the lower portion by a hinge for relative movement between opened and closed positions, so that the remote dispensing station can be opened for serving beverages and closed to secure the dispensing station and its contents during times of non-operation;

at least one conduit for transporting the beverage from the at least one beverage tank to the remote dispensing station;

a dispensing spigot in the remote dispensing station; and at least one dispensing pump, having access to the beverage, configured for pumping the beverage from the beverage tank through the conduit to the dispensing spigot.

21. The system or claim 20 wherein the remote dispensing station further comprises a hydraulic lift system to assist in the opening and closing of the upper portion of the remote dispensing station.

22. A system for providing a beverage, comprising:

a remote dispensing station, for delivery of the beverage to customers;

at least one beverage tank, for containing a quantity of the beverage, wherein the remote dispensing station is fomnied and colored to resemble at least one fruit or vegetable associated with the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot.

23. A system for providing a beverage, comprising:

a remote dispensing station, for delivery of the beverage to customers;

at least one beverage tank, for containing a quantity of the beverage, wherein the remote dispensing station is formed and colored to resemble a collection or arrangement of fruits or vegetables or the same or different types associated with one or more ingredients of the beverage;

at least one conduit for transporting the beverage from the at least one beverage tank to the remote dispensing station;

a dispensing spigot in the remote dispensing station;

at least one dispensing pump, having access to the beverage, configured for pumping the beverage from the beverage tank through the conduit to the dispensing spigot.

24. A method for providing a beverage, comprising:

introducing a quantity of a beverage into a beverage tank through a fill opening;

connecting the beverage tank via one or more conduits to a serving spigot in a dispensing station located remotely from the beverage tank;

sensing the pressure in the one or more conduits at a point between the beverage tank and the serving spigot;

opening the serving spigot to cause a flow of beverage from the beverage tank and out the serving spigot; and pumping the beverage from the beverage tank to the serving spigot when the pressure in the conduit drops below a selected level or range.

25. The method of claim 24, wherein the beverage in the beverage tank is maintained at a selected temperature or within a selected temperature range by surrounding the beverage tank with an environmentally-controlled enclosure.

26. The method of claim 24, wherein the beverage in the beverage tank is maintained at a selected temperature or within a selected temperature range by:

surrounding the beverage tank with an environmentally-controlled enclosure;

mounting a refrigeration unit inside of the environmentally-controlled enclosure for temperature regulation of the enclosure;

connecting a condenser, located outside of the enclosure, to the refrigeration unit; and providing a power source to run the refrigeration unit and condenser.

27. The method of claim 26, further comprising:

a timer device to periodically turn the refrigeration unit and off at specified intervals to achieve maximum cooling efficiency.

28. A method for providing a beverage, comprising:

introducing a quantity of a beverage into a beverage tank through a fill opening;

connecting tie beverage tank via one or more conduits to a serving spigot in a dispensing station located remotely from the beverage tank;

connecting a bypass valve between at least two dispensing pumps;

using said bypass valve to select the dispensing pump to operate for delivery of the beverage to the serving valve; and opening the serving spigot to cause a flow of beverage from the beverage tank, and out the serving spigot.

29. A method for providing a beverage, comprising:

introducing a quantity of a beverage into a beverage tank through a fill opening;

connecting the beverage tank via one or more conduits to a serving spigot in a dispensing station located remotely from the beverage tank;

opening the serving spigot to cause a flow of beverage from the beverage tank and out the serving spigot; and adding ice from an ice basin in the remote dispensing station to the dispensed beverage to reduce the temperature of the beverage.

30. A method for providing a beverage, comprising:

introducing a quantity of a beverage into a beverage tank through a fill opening;

connecting the beverage tank via one or more conduits to a serving spigot in a dispensing station located remotely from the beverage tank;

installing a mixing pump in the beverage tank for circulating a portion of the beverage in the beverage tank to promote uniform temperature, taste, and consistency of the beverage;

connecting a first feed conduit to the mixing pump in the beverage tank for delivering a portion of the beverage into the mixing pump;

connecting a discharge conduit to the mixing pump for delivering a portion of the beverage into the beverage tank; and opening the serving spigot to cause a flow of beverage from the beverage tank and out the serving spigot.

31. A method for providing a beverage, comprising:

introducing a quantity of a beverage into a beverage tank through a fill opening;

connecting the beverage tank via one or more conduits to a serving spigot in a dispensing station located remotely from the beverage tank, wherein the remote dispensing station is formed and colored to resemble at least one fruit or vegetable associated with the beverage; and opening the serving spigot to cause a flow of beverage from the beverage tank and out the serving spigot.

32. A method for providing a beverage, comprising:

introducing a quantity of a beverage into a beverage tank through a fill opening;

connecting the beverage tank via one or more conduits to a serving spigot in a dispensing station located remotely front the beverage tank, wherein the remote dispensing station is formed and colored to resemble a collection or arrangement of fruits or vegetables associated with the beverage; and opening the serving spigot to cause a flow of beverage front the beverage tank and out the serving spigot.

33. A method for providing a beverage, comprising:

introducing a quantity of a beverage into a beverage tank through a fill opening;

connecting the beverage tank via one or more conduits to a serving spigot in a dispensing station located remotely from the beverage tank;

connecting a wheel to the wheel axle for rolling of the remote dispensing station; and opening the serving spigot to cause a flow of beverage from the beverage tank and out the serving spigot.

* * * * *